US006739739B2

(12) United States Patent
Lu et al.

(10) Patent No.: US 6,739,739 B2
(45) Date of Patent: May 25, 2004

(54) FLASH TUBE REFLECTOR

(75) Inventors: Jih-Yung Lu, Sanchung (TW); Chih-Po Yang, Taipei (TW); Rex Liao, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/167,394

(22) Filed: Jun. 13, 2002

(65) Prior Publication Data

US 2003/0231498 A1 Dec. 18, 2003

(51) Int. Cl.[7] ..... F21V 7/00

(52) U.S. Cl. ..... 362/347; 362/346; 362/350; 362/298; 362/297

(58) Field of Search ..... 362/347, 346, 362/298, 297

(56) References Cited

U.S. PATENT DOCUMENTS 4,218,727 A * 8/1980 Shemitz et al. ..... 362/297
5,136,491 A * 8/1992 Kano ..... 362/346
5,619,737 A 4/1997 Horning et al.

FOREIGN PATENT DOCUMENTS

TW 430068 4/2001

* cited by examiner

*Primary Examiner*—Sandra O'Shea
*Assistant Examiner*—Anabel Ton
(74) *Attorney, Agent, or Firm*—Rabin & Berdo, P.C.

(57) ABSTRACT

A flash tube reflector able to distribute light of the flash tube evenly is disclosed. The reflector is a vertical portion of an elliptic cylinder extending along an Y-axis. A cross section of the reflector along the XY plane is a portion of an ellipse. A zenith E at the reflector intersects the X-axis. The flash tube contacts the reflector at E. A is a center of the flash tube and c is a distance between E and A. F1 is a first focus of the ellipse of the reflector and f1 is a distance between E and F1. F2 is a second focus of the ellipse and f2 is a distance between E and F2. The relations of c, f1, and f2 are $0.20 \leqq c/f1 \leqq 0.45$ and $0.14 \leqq f1/f2 \leqq 1.0$.

19 Claims, 5 Drawing Sheets

FLASH TUBE REFLECTOR

BACKGROUND OF THE INVENTION

1. Field of the Invention

The invention relates in general to a flash tube reflector, and more particularly to a flash tube reflector with minimized size and optimized illumination.

2. Description of the Related Art

Illumination is one of the major requirements to produce a high quality photograph. Illumination in different environments and weather could be various. To keep the illumination up to an ideal level for taking a photograph, a flashlight is always used associated with a camera. Apart from the flash tube, the reflector is also a key compartment of the flashlight.

FIG. 1 shows a conventional reflector, which is associated with a flash tube (not shown). FIG. 2 is a cross-section of the reflector along the dot line 2—2 in FIG. 1. The reflector 100 is an arc-shaped light-reflection material. A flash tube 200 is positioned in the concave of the reflector 100. The flash tube 200 is typically positioned around the central axis 210. The shape of the flash tube 200, the feature of the reflector 100, and the relative position between the flash tube and the reflector could determine the quality of light flashing.

However, the curve of the conventional reflector 100 is not properly designed so that the illumination is not optimized. Also, while an optimized distribution of the light is needed, the size of the whole reflector 100 could increase, which is not ideal for a small sized camera.

SUMMARY OF THE INVENTION

It is therefore an object of the invention to provide a flash tube reflector for a flash tube to distribute light of the flash tube evenly. The reflector is a vertical portion of an elliptic cylinder extending along a Y-axis, and a cross section of the reflector along the XY plane is a portion of an ellipse. The zenith E at the reflector intersects the X-axis, and the flash tube contacts the reflector at E. The point A is a center of the flash tube and c is a distance between E and A, the point F1 is a first focus of the ellipse and f1 is a distance between E and F1, the point F2 is a second focus of the ellipse and f2 is a distance between E and F2. The relations of c, f1, and f2 include $0.20 \leqq c/f1 \leqq 0.45$ and $0.14 \leqq f1/f2 \leqq 1.0$.

It is therefore a further object of the invention to provide a flash tube reflector of a flash tube with an enhanced brightness. The reflector is a vertical portion of an elliptic cylinder extending along a Y-axis, a cross section of the reflector along the XY plane is a portion of an ellipse, and a zenith E at the reflector intersects the X-axis. The flash tube contacts the reflector at E, and a point A is a center of the flash tube and c is a distance between E and A. The point F1 is a first focus of the ellipse and f1 is a distance between E and F1. The point F2 is a second focus of the ellipse and f2 is a distance between E and F2. The relations of c, f1, and f2 are $0.24 \leqq c/f1 \leqq 0.55$ and $0.07 \leqq f1/f2$.

It is therefore another object of the invention to provide a flash tube reflector of a flash tube with an enhanced brightness. The reflector is a vertical portion of an elliptic cylinder extending along a Z-axis and a cross section of the reflector in the XY plane is a portion of an ellipse. A zenith E of the reflector intersects the X-axis, and the flash tube contacts the reflector at E. A point A is a center of the flash tube and c is a distance between E and A, a point F1 is a first focus of the ellipse and f1 is a distance between E and F1, a point F2 is a second focus of the ellipse and f2 is a distance between E and F2 and the relation of c and f1 is $0.35 \leqq c/f1 \leqq 0.40$. The reflector further includes a first extension coupled to a first terminal of the reflector and extending substantially parallel to the X-axis, and a second extension coupled to a second terminal of the reflector and extending substantially parallel to the X-axis.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
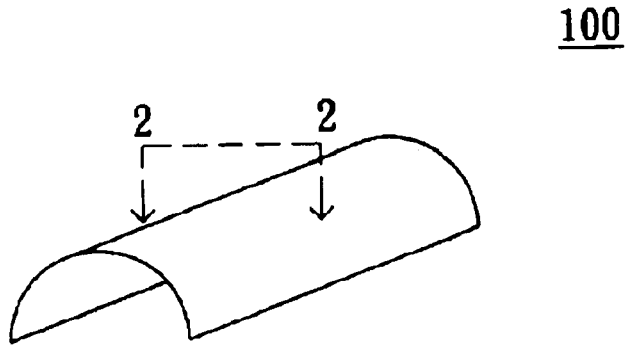
FIG. 1 (PRIOR ART)
FIG. 1 (Prior Art) shows a conventional reflector, which is associated with a flash tube (not shown).
Figure 2:
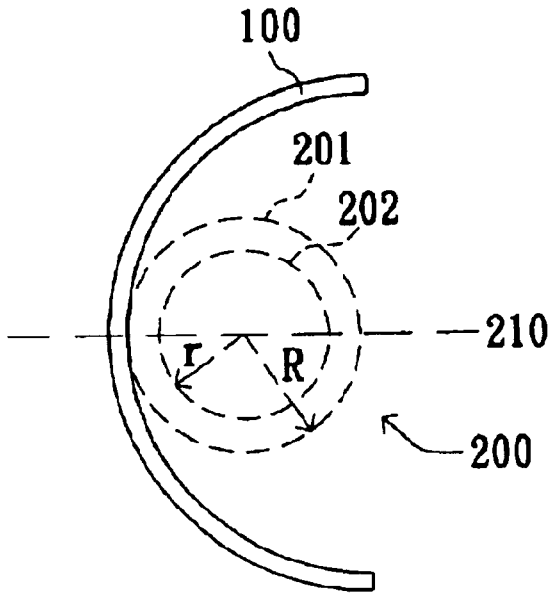
FIG. 2 (PRIOR ART)
FIG. 2 (Prior Art) is a cross-section of the reflector in FIG. 1 along the dot line 2—2.
Figure 3A:
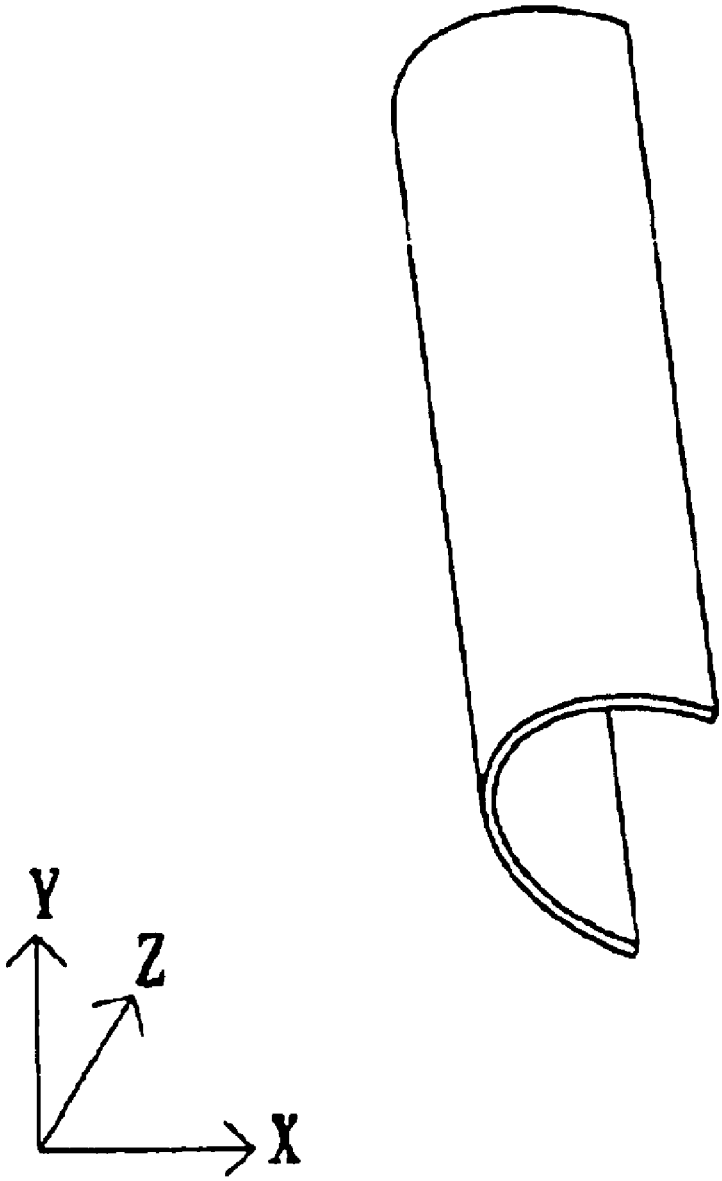
FIG. 3A shows one example of the reflectors according to a preferred embodiment of the invention.
Figure 3B:
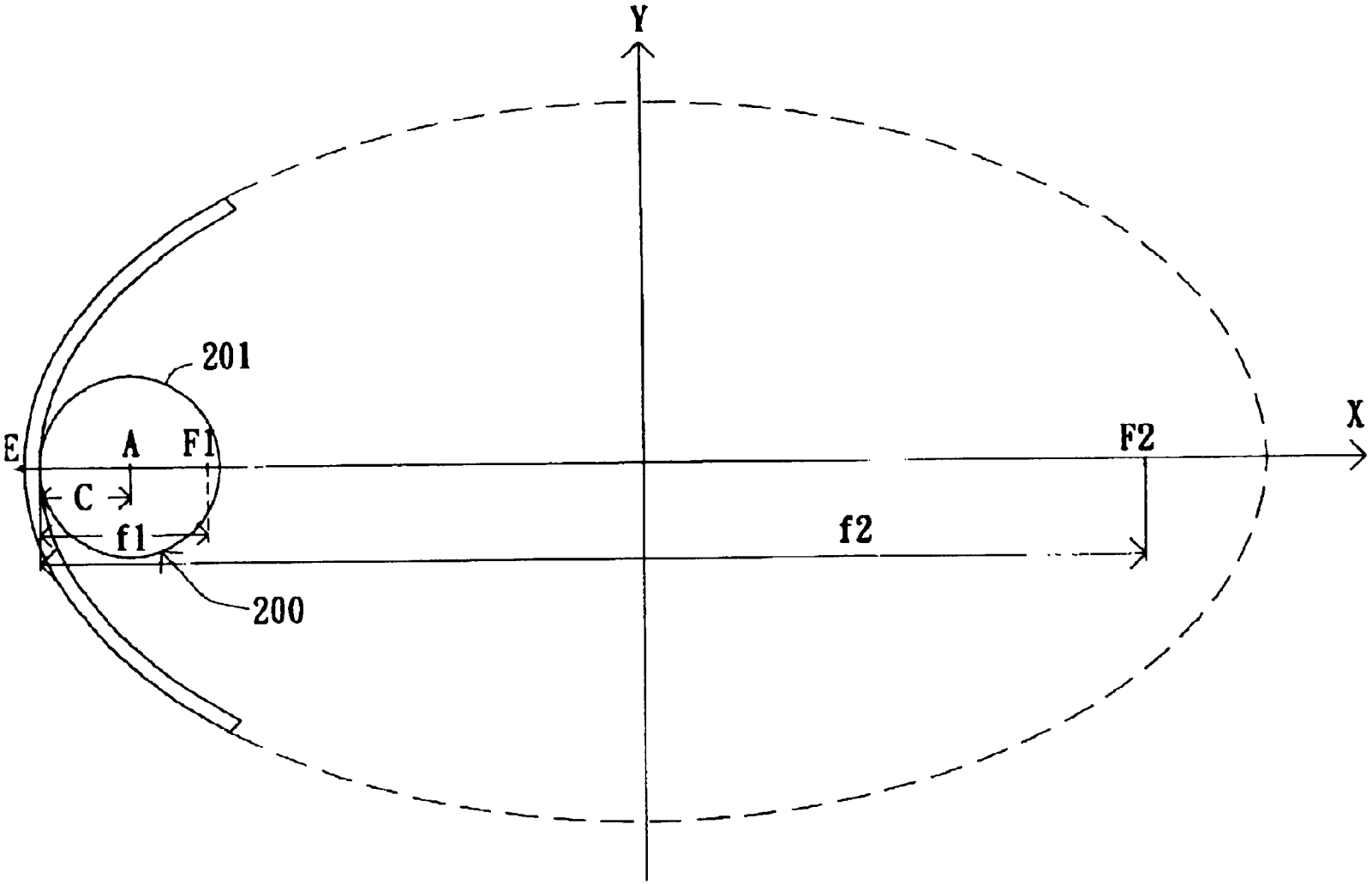
FIG. 3B is the cross-section of the reflector as shown in FIG. 3A along the X-Y plane.

Referring to FIG. 3A, one example of the reflectors used associated with a flash tube is shown. The reflector 300 is a vertical portion of an elliptic cylinder extending along the Z-axis so that the cross section of the reflector 300 as shown in FIG. 3B is a portion of an ellipse. For the advantages of describing the orientation of the reflector 300, axes X,Y and Z are used and defined as in the FIGS. 3A and 3B. FIG. 3B is the cross-section of the reflector 300 of FIG. 3A in the X-Y plane.

As shown in FIG. 3B, the zenith E is the only point where the reflector 300 intersects the X-axis, and is also the bottom point of the reflector 300. The point A is the center of the flash tube 200. The distance between A and E is c. The flash tube 200 is positioned to contact with the reflector 300, and only contacts with the reflector 300 at the zenith E. The flash tube can be any conventional one and is not limited. The point F1 is the first focus of the virtual ellipse. The distance between the point F1 and the zenith E is f1. The point F2 is the second focus of the virtual ellipse, and the distance between the point F2 and the zenith Z is f2.

The basic feature of the reflector 300 is as shown in FIG. 3A. The preferred curve of the reflector 300 is decided experimentally or by computer simulation. The reflector 300 can be modified to further include two extensions at two sides of the basic reflector of the invention. The preferred cure and detailed features of the reflectors are described by the following examples.

EXAMPLE 1

The reflector 300 in the first example of the invention is designed to be able to distribute light of the flash tube 200 evenly. The reflector 300 can be made of a light-reflection material, or the interior of the reflector 300 can be coated with a light-reflection material.

The feature of the reflector 300 is defined by the parameters c, f1 and f2. As shown in FIG. 3B, c is the distance between the center A and the zenith E, f1 is the distance between the focus F1 and the zenith E, and f2 is the distance between the focus F2 and the zenith E. The relations of c, f1, f2 can be one of the following list:

$0.20 \leqq c/f1 \leqq 0.45$, and $0.14 \leqq f1/f2 \leqq 1.0$;

$0.40 \leqq c/f1 \leqq 0.45$ and $0.14 \leqq f1/f2 \leqq 0.2$;

$0.35 \leqq c/f1 \leqq 0.40$ and $0.16 \leqq f1/f2 \leqq 0.37$;

$0.30 \leqq c/f1 \leqq 0.35$ and $0.2 \leqq f1/f2 \leqq 0.6$;

$0.24 \leqq c/f1 \leqq 0.30$ and $0.29 \leqq f1/f2 \leqq 0.88$; and $0.20 \leqq c/f1 \leqq 0.24$ and $0.40 \leqq f1/f2 \leqq 1.0$.

When the reflector 300 is designed by the above rules, the reflector 300 can distribute light of the flash tube 200 evenly.

EXAMPLE 2

The reflector 300 in the second example of the invention is designed to be able to enhance brightness away from the flash tube 200. The reflector 300 can be made of a light-reflection material, or the interior of the reflector 300 can be coated with a light-reflection material.

The feature of the reflector 300 is defined by the parameters c, f1 and f2. As shown in FIG. 3B, c is the distance between the center A and the zenith E, f1 is the distance between the focus F1 and the zenith E, and f2 is the distance between the focus F2 and the zenith E. The relations of c, f1, f2 can be one of the following list:

$0.24 \leqq c/f1 \leqq 0.55$ and $0.07 \leqq f1/f2$;

$0.45 \leqq c/f1 \leqq 0.55$ and $0.07 \leqq f1/f2$;

$0.40 \leqq c/f1 \leqq 0.45$ and $0.18 \leqq f1/f2$;

$0.35 \leqq c/f1 \leqq 0.40$ and $0.35 \leqq f1/f2$;

$0.30 \leqq c/f1 \leqq 0.35$ and $0.6 \leqq f1/f2$; and $0.24 \leqq c/f1 \leqq 0.30$ and $0.88 \leqq f1/f2$.

When the reflector 300 is designed by the above rules, the reflector 300 can distribute light of the flash tube 200 evenly. In addition, the light emitted away from the reflector 300 and the flash tube 200 would have increased brightness.

EXAMPLE 3

Figure 4A:
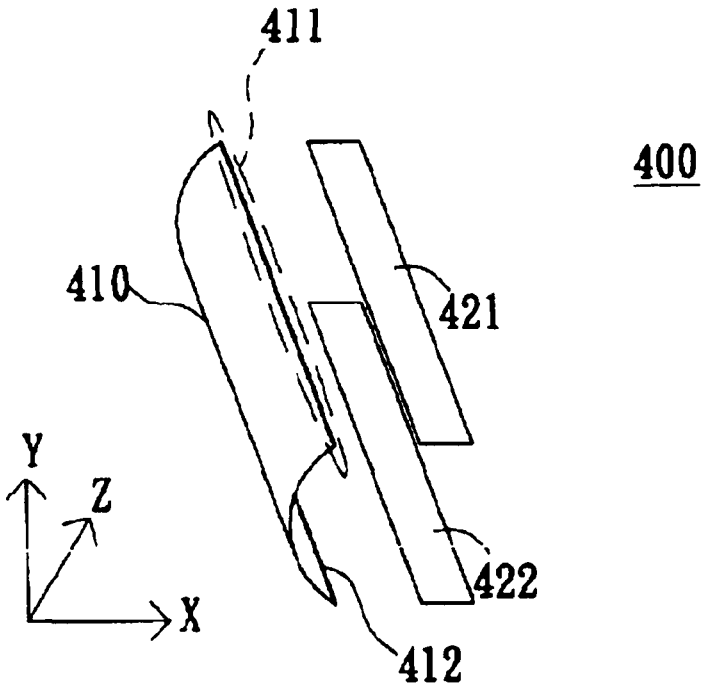
FIGS. 4A to 4B show another example of the reflectors according to other preferred embodiment of the invention.
Figure 4B:
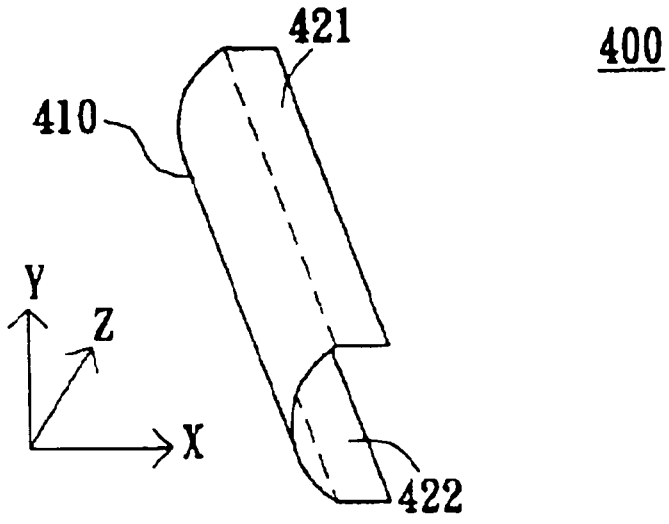

Referring to FIG. 4A and FIG. 4B, the reflector 400 in the third example of the invention is designed to be able to enhance brightness away from the flash tube 200. The reflector 400 can be made of a light-reflection material, or the interior of the reflector 400 can be coated with a light-reflection coating.

Figure 4C:
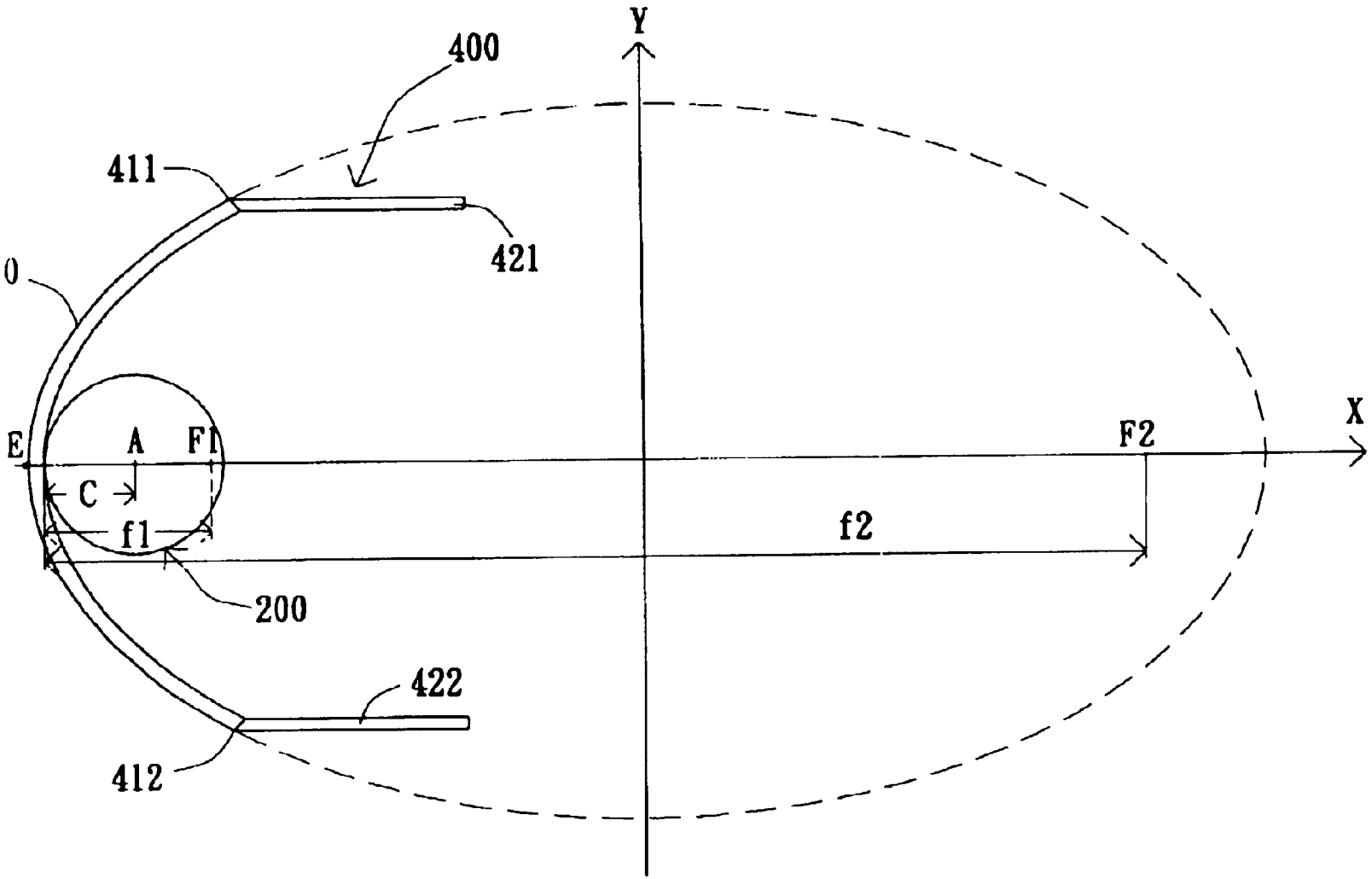
FIG. 4C is the cross-section of the reflector as shown in FIG. 4B along the X-Y plane.

Referring to FIG. 4C, the feature of the reflector 400 is defined by the parameters c, f1 and f2. As shown in FIG. 4C, c is the distance between the center A and the zenith E, f1 is the distance between the focus F1 and the zenith E, and f2 is the distance between the focus F2 and the zenith E. The relations of c and f1 is $0.35 \leqq c/f1 \leqq 0.40$. The reflector 400 further includes a first extension 421 and a second extension 422. The first extension 421 is coupled to the first terminal 411 of the reflector 400, the second extension 422 is coupled to the second terminal 412 of the reflector 400, and both of the first extension 421 and the second extension 422 substantially extend along the X-axis.

The reflector of the invention includes at least the following advantages:

1. The distribution of illumination is optimized.
2. The two extensions can further protect the flash tube.
3. The reflector can be controlled in a certain size.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flash tube reflector used associated with a flash tube and able to distribute light of the flash tube evenly, wherein the reflector is a portion of an elliptic cylinder extending along a Z-axis, a cross section of the reflector in an XY plane is a portion of an ellipse, a zenith E of the reflector intersects a X-axis, the flash tube contacts the reflector at E. A is a center of the flash tube and c is a distance between E and A. F1 is a first focus of the ellipse and f1 is a distance between E and F1. F2 is a second focus of the ellipse and f2 is a distance between E and F2. f1 is smaller than f2. and the relations of c, f1, and f2 are $0.20 \leqq c/f1 \leqq 0.45$ and $0.14 \leqq f1/f2 \leqq 1.0$.

2. The flash tube reflector as claimed in claim 1, wherein the reflector is made of a light-reflection material.

3. The flash tube reflector as claimed in claim 1, wherein an interior of the reflector is coated with a light-reflection material.

4. The flash tube reflector as claimed in claim 1, wherein the relations of c, f1, and f2 are $0.40 \leqq cf1 \leqq 0.45$ and $0.14 \leqq f1/f2 \leqq 0.2$.

5. The flash tube reflector as claimed in claim 1, wherein the relations of c, f1, and f2 are $0.35 \leqq c/f1 \leqq 0.40$ and $0.16 \leqq f1/f2 \leqq 0.37$.

6. The flash tube reflector as claimed in claim 1, wherein the relations of c, f1, and f2 are $0.30 \leqq c/f1 \leqq 0.35$ and $0.2 \leqq f1/f2 \leqq 0.6$.

7. The flash tube reflector as claimed in claim 1, wherein the relations of c, f1, and f2 are $0.24 \leqq c/f1 \leqq 0.30$ and $0.29 \leqq f1/f2 \leqq 0.88$.

8. The flash tube reflector as claimed in claim 1, wherein the relations of c, f1, and f2 are $0.20 \leqq c/f1 \leqq 0.24$ and $0.40 \leqq f1/f2 \leqq 1.0$.

9. A flash tube reflector used associated with a flash tube and able to enhance brightness away from the flash tube, wherein the reflector is a portion of an elliptic cylinder extending along a Z-axis, a cross section of the reflector in an XY plane is a portion of an ellipse, a zenith E of the reflector intersects a X-axis. the flash tube contacts the reflector at E, a point A is a center of the flash tube and c is a distance between E and A, a point F1 is a first focus of the ellipse and f1 is a distance between E and F1, a point F2 is a second focus of the ellipse and f2 is a distance between E and F2, f1 is smaller than f2, and the relations of c, f1, and f2 are $0.24 \leqq c/f1 \leqq 0.55$ and $0.07 \leqq f1/f2$.

10. The flash tube reflector as claimed in claim 9, wherein the reflector is made of a light-reflection material.

11. The flash tube reflector as claimed in claim 9, wherein an interior of the reflector is coated with a light-reflection coating.

12. The flash tube reflector as claimed in claim 9, wherein the relations of c, f1, and f2 are $0.45 \leqq c/f1 \leqq 0.55$ and $0.07 \leqq f1/f2$.

13. The flash tube reflector as claimed in claim 9, wherein the relations of c, f1, and f2 are $0.40 \leqq c/f1 \leqq 0.45$ and $0.18 \leqq f1/f2$.

14. The flash tube reflector as claimed in claim 9, wherein the relations of c, f1, and f2 are $0.35 \leqq c/f1 \leqq 0.40$ and $0.35 \leqq f1/f2$.

15. The flash tube reflector as claimed in claim 9, wherein the relations of c, f1, and f2 are $0.30 \leqq c/f1 \leqq 0.35$ and $0.6 \leqq f1/f2$.

16. The flash tube reflector as claimed in claim 9, wherein the relations of c, f1, and f2 are $0.24 \leqq c/f1 \leqq 0.30$ and $0.88 \leqq f1/f2$.

17. A flash tube reflector used associated with a flash tube and able to enhance brightness away from the flash tube, wherein the reflector includes a portion of a single elliptic cylinder extending along a Z-axis, a cross section of the reflector along a XY plane is a portion of an ellipse, a zenith E at the reflector intersects a X-axis, the flash tube contacts the reflector at E, a point A is a center of the flash tube and c is a distance between E and A, a point F1 is a first focus of the ellipse and f1 is a distance between E and F1, a point F2 is a second focus of the ellipse and f2 is a distance between F and F2, the relation of c and f1 is $0.35 \leqq c/f1 \leqq 0.40$, and the reflector further comprises:

a first extension coupled to a first terminal of the reflector, and extending substantially parallel to the X-axis; and a second extension coupled to a second terminal of the reflector, and extending substantially parallel to the X-axis.

18. The flash tube reflector as claimed in claim 17, wherein the reflector is made of a light-reflection material.

19. The flash tube reflector as claimed in claim 17, wherein an interior of the reflector is coated with a light-reflection material.

* * * * *